United States Patent [19]

Adams

[11] Patent Number: 4,530,589

[45] Date of Patent: Jul. 23, 1985

[54] XEROGRAPHIC COPYING APPARATUS HAVING MEANS TO REDUCE CONTAMINATION OF OPTICAL COMPONENTS

[75] Inventor: John N. Adams, Knebworth, England

[73] Assignee: Xerox Corporation, Stamford, Conn.

[21] Appl. No.: 534,043

[22] Filed: Sep. 20, 1983

[30] Foreign Application Priority Data

Sep. 21, 1982 [GB] United Kingdom ..... 8226846

[51] Int. Cl.[3] ..... G03G 15/00

[52] U.S. Cl. ..... 355/3 R; 355/30

[58] Field of Search ..... 355/3 R, 15, 133, 30, 355/3 FU, 11, 3 DD; 15/1.5, 300, 309

[56] References Cited

U.S. PATENT DOCUMENTS

| | | | |
|---|---|---|---|
| T940,022 | 11/1975 | Rodda | 355/3 R |
| 3,914,046 | 10/1975 | Tanaka et al. | 355/15 |
| 4,106,057 | 8/1978 | Van Vroenhoven | 358/128 |
| 4,178,092 | 12/1979 | Yamamoto et al. | 355/3 CH |

FOREIGN PATENT DOCUMENTS

| | | | |
|---|---|---|---|
| 2425137 | 12/1974 | Fed. Rep. of Germany | 355/3 R |
| 2462287 | 8/1976 | Fed. Rep. of Germany | 355/3 R |

*Primary Examiner*—R. L. Moses

[57] ABSTRACT

Xerographic copying apparatus includes an optical system for forming an optical image of an object to be copied on an electrically charged photoconductive surface, the optical image forming a corresponding electrostatic latent image on the surface, and means to develop the latent image with a particulate toner material. At least part of the optical system is housed in a substantially closed compartment, and imaging rays are directed out of the compartment in a generally horizontal direction through a substantially vertical transparent window in the compartment. A blower is provided to blow a curtain of air generally downwardly over the surface of the window outside the compartment, and to blow air into the optics compartment so as to cause a net outflow of air from the optics compartment.

4 Claims, 4 Drawing Figures

XEROGRAPHIC COPYING APPARATUS HAVING MEANS TO REDUCE CONTAMINATION OF OPTICAL COMPONENTS

BACKGROUND OF THE INVENTION

This invention relates to a xerographic copying apparatus. Such an apparatus includes an optical system for forming an optical image of an object to be copied on an electrically charged photoconductive surface, the optical image forming a corresponding electrostatic latent image on the surface, and means to develop the latent image with a particulate toner material.

The particulate toner material used in a xerographic copying machine to develop the electrostatic latent image is usually a fine black powder which, unless carefully confined within the machine, can deposit on various components of the machine, with deleterious effect. In particular, the ingress of toner into the optical system gives rise to the deposition of toner on the optical surfaces of lenses and mirrors, with consequent degredation of image quality.

Although it is not usually possible to provide a sealed optical system, i.e. one in which the major optical components are within a totally sealed compartment, it is possible to form a substantially closed compartment containing the major optical components. In this way, the ingress of toner may be kept to a low level.

SUMMARY OF THE INVENTION

It is an object of the present invention to further reduce the ingress of toner so that the optical system does not need cleaning at at frequent intervals.

It is a further object of the invention to provide an inexpensive way to considerably reduce toner contamination of the optical system.

According to the present invention, there is provided a xerographic copying apparatus wherein at least part of the optical system is housed in a substantially closed compartment, imaging rays are directed out of the compartment in a generally horizontal direction through a substantially vertical transparent window in said compartment, and means are provided to blow a curtain of air generally downwardly over the surface of said window outside the compartment.

The foregoing and other objects, features and advantages of the invention will be apparent from the following more particular description of the preferred embodiments of the invention, as illustrated in the accompanying drawings.

DESCRIPTION OF THE PREFERRED EMBODIMENT

Figure 1:
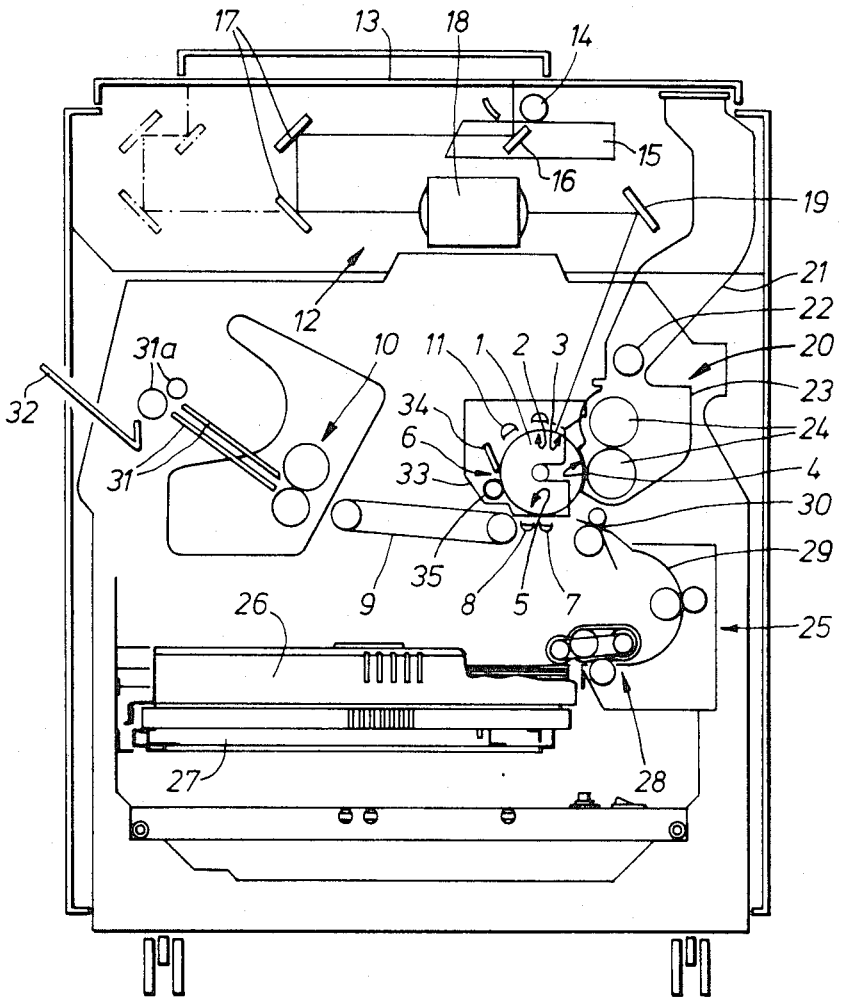
FIG. 1 is a diagramatic cross-sectional view of a xerographic copying machine incorporating the invention.

Referring first to FIG. 1 there is shown a xerographic copying machine incorporating the present invention. The machine includes a photoreceptor drum 1 mounted for rotation (in the clockwise direction as seen in FIG. 1) to carry the photoconductive imaging surface of the drum sequentially through a series of xerographic processing stations; a charging station 2, an imaging station 3, a development station 4, a transfer station 5, and a cleaning station 6.

The charging station 2 comprises a corotron which deposits a uniform electrostatic charge on the photoreceptor. A document to be reproduced is positioned on a platen 13 and scanned by means of a moving optical scanning system to produce a flowing light image on the drum at 3. The optical image selectively discharges the photoconductor in image configuration, whereby an electrostatic latent image of the object is laid down on the drum surface. At the development station 4, the electrostatic latent image is developed into visible form by bringing into contact with it toner particles which deposit on the charged areas of the photoreceptor. Cut sheets of paper are moved into the transfer station 5 in synchronous relation with the image on the drum surface and the developed image is transferred to a copy sheet at the transfer station 5, where a transfer corotron 7 provides an electric field to assist in the transfer of the toner particles thereto. The copy sheet is then stripped from the drum 1, the detachment being assisted by the electric field provided by an a.c. de-tack corotron 8. The copy sheet carrying the developed image is then carried by a transport belt system 9 to a fusing station 10.

After transfer of the developed image from the drum, some toner particles usually remain on the drum, and these are removed at the cleaning station 6. After cleaing, any electrostatic charges remaining on the drum are removed by an a.c. erase corotron 11. The photoreceptor is then ready to be charged again by the charging corotron 2, as the first step in the next copy cycle.

The optical image at imaging station 3 is formed by optical system 12. A document (not shown) to be copied is placed on platen 13, and is illuminated by a lamp 14 that is mounted on a scanning carriage which also carries a mirror 16. Mirror 16 is the full-rate scanning mirror of a full and half-rate scanning system. The full-rate mirror 16 reflects an image of a strip of the document to be copied onto the half-rate scanning mirrors 17. The image is focussed by a lens 18 onto the drum 1, being deflected by a fixed mirror 19. In operation, the full-rate mirror 16 and lamp 14 are moved across the machine at a constant speed, while at the same time the half-rate mirrors 17 are moved in the same direction at half that speed. At the end of a scan, the mirrors are in the position shown in a broken outline at the left hand side of FIG. 1. These movements of the mirrors maintain a constant optical path length, so as to maintain the image on the drum in sharp focus throughout the scan.

At the development station 4, a magnetic brush developer system 20 develops the electrostatic latent image. Toner is dispensed from a hopper 21 by means of a rotating foam roll dispenser 22, into developer housing 23. Housing 23 contains a two-component developer mixture comprising a magnetically attractable carrier and the toner, which is brought into developing engagement with drum 1 by a two-roller magnetic brush developing arrangement 24.

The developed image is transferred at transfer station 5, from the drum to a sheet of copy paper (not shown) which is delivered into contact with the drum by means of a paper supply system 25. Paper copy sheets are stored in two paper trays, an upper, main tray 26 and a lower, auxiliary tray 27. The top sheet of paper in either one of the trays is brought, as required, into feeding engagement with a common, fixed position, sheet separator/feeder 28. Sheet feeder 28 feeds sheets around curved guide 29 for registration at a registration point 30. Once registered, the sheet is fed into contact with the drum in synchronous relation to the image so as to receive the image at transfer station 5.

The copy sheet carrying the transferred image is transported, by means of vacuum transport belt 9, to fuser 10, which is a heated roll fuser. The image is fixed to the copy sheet by the heat and pressure in the nip between the two rolls of the fuser. The final copy is fed by the fuser rolls along output guides 31 into catch tray 32, which is suitably an offsetting catch tray, via output nip rolls 31*a*.

After transfer of the developed image from the drum to the copy sheet, the drum surface is cleaned at cleaning station 6. At the cleaning station, a housing 33 forms with the drum 1 an enclosed cavity, within which is mounted a doctor blade 34. Doctor blade 34 scrapes residual toner particles off the drum, and the scraped-off particles then fall into the bottom of the housing, from where they are removed by an auger.

Figure 2:
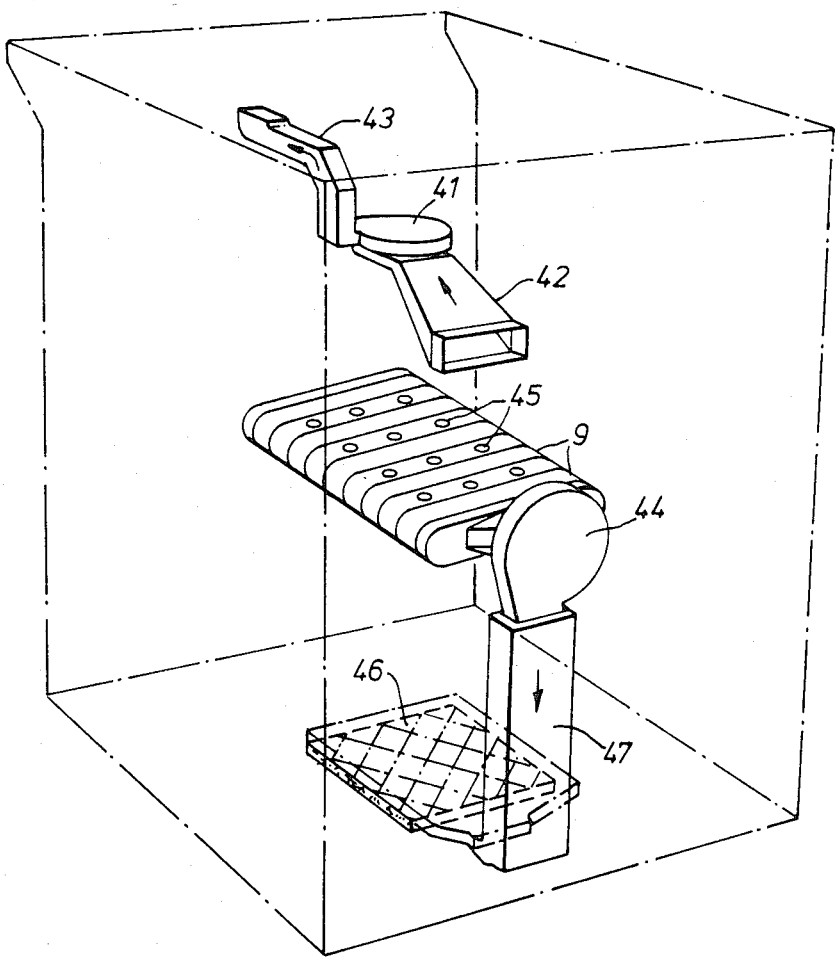
FIG. 2 is a perspective view, taken from the rear of the mechine of FIG. 1, showing only the basic components of an arrangement for blowing air into, and extracting air from, the machine.

Referring to FIG. 2, a first blower 41 is mounted in the upper part of the machine, and is arranged to blow air into the optics compartment, which comprises approximately the uppermost quarter of the interior volume of the machine. Air is drawn through an inlet duct 42 at the rear of the machine, where it is filtered to remove dust. Blower 41 blows air out through a duct 43 into the optics compartment.

In the lower part of the machine, a second blower 44 draws air in through holes 45 in the transport belt system 9, which system serves the dual purpose of purging air from the xerographic process area, and providing the vacuum which secures copies to the transport belts. Air from the region where the xerographic process is carried out normally contains ozone, generated by the corotrons, and this is filtered by an ozone filter 46 in the base of the machine, connected to the outlet duct 47 of the second blower 44.

Figure 3:
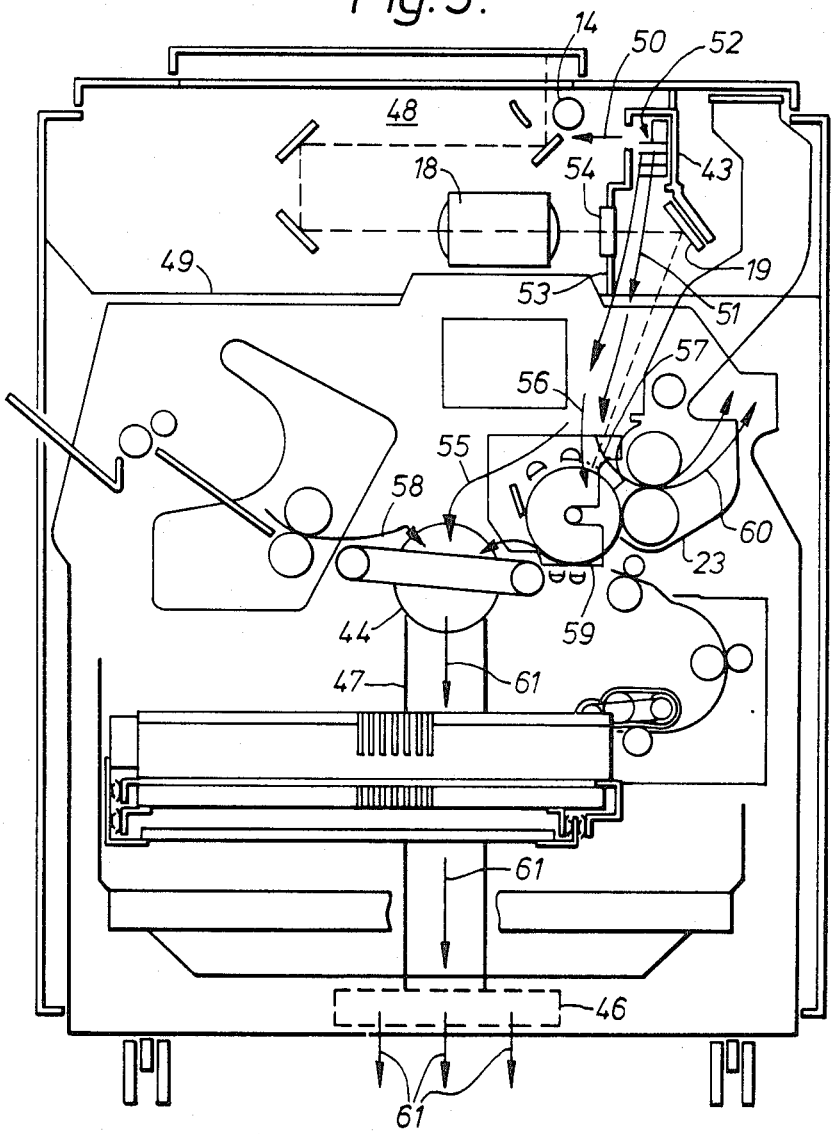
FIG. 3 is a view corresponding with FIG. 1, showing the air flows produced by the arrangement of FIG. 2.

Referring to FIG. 3, the outlet duct 43 of the first blower 41 is arranged to blow air both into and alongside the optics compartment 48. The optics compartment 48 is a substantially closed chamber with a tray represented generally by 49 substantially closing off approximately the uppermost quarter of the interior volume of the machine. A set of ledges are provided around the insides of the exterior panels of the machine, to overlap with tray 49, so as to achieve the substantial closure of the compartment. Air from duct 43 is blown towards the lamp 14 within the optics compartment for cooling purposes, as indicated by arrow 50 as well as downwardly, as indicated by arrows 51, outside the optics compartment. These two air flows are produced by a baffle arrangement 52 which will be described below with reference to FIG. 4. The baffle arrangement 52 is mounted in the right-hand side of the optics compartment, which is substantially closed as indicated by a wall 53. Where the wall 53 passes between lens 18 and fixed mirror 19 (mirror 19 being outside the optics compartment) a transparent window 54 is provided, preferably of optically flat glass. This prevents the ingress of toner particles or other contaminants, into the optics compartment, but has an insignificant effect on the optical performance of the optical system. The current of air represented by arrows 51 is in the form of a curtain which blows downwardly over the surface of the window 54 which is outside the optics compartment, thereby preventing toner particles from settling on the window.

The downwardly flowing air then proceeds generally as indicated by the arrows. It blows over and around the photoconductor 1, as indicated by arrows 55, 56 and 57, the flow indicated by arrow 55 being extracted by way of the vacuum transport system 9. The suction created by the vacuum transport system draws air from the region of the fuser (arrow 58) as well as from below the photoconductor drum (arrow 59). A small negative pressure (arrow 60) is created in the developer housing by means of a separate duct (not shown) connected between the input side of blower 44 and the developer housing 23.

Air extracted by the vacuum transport system is blown down (arrow 61) through the ozone filter 46 in the base of the machine.

Figure 4:
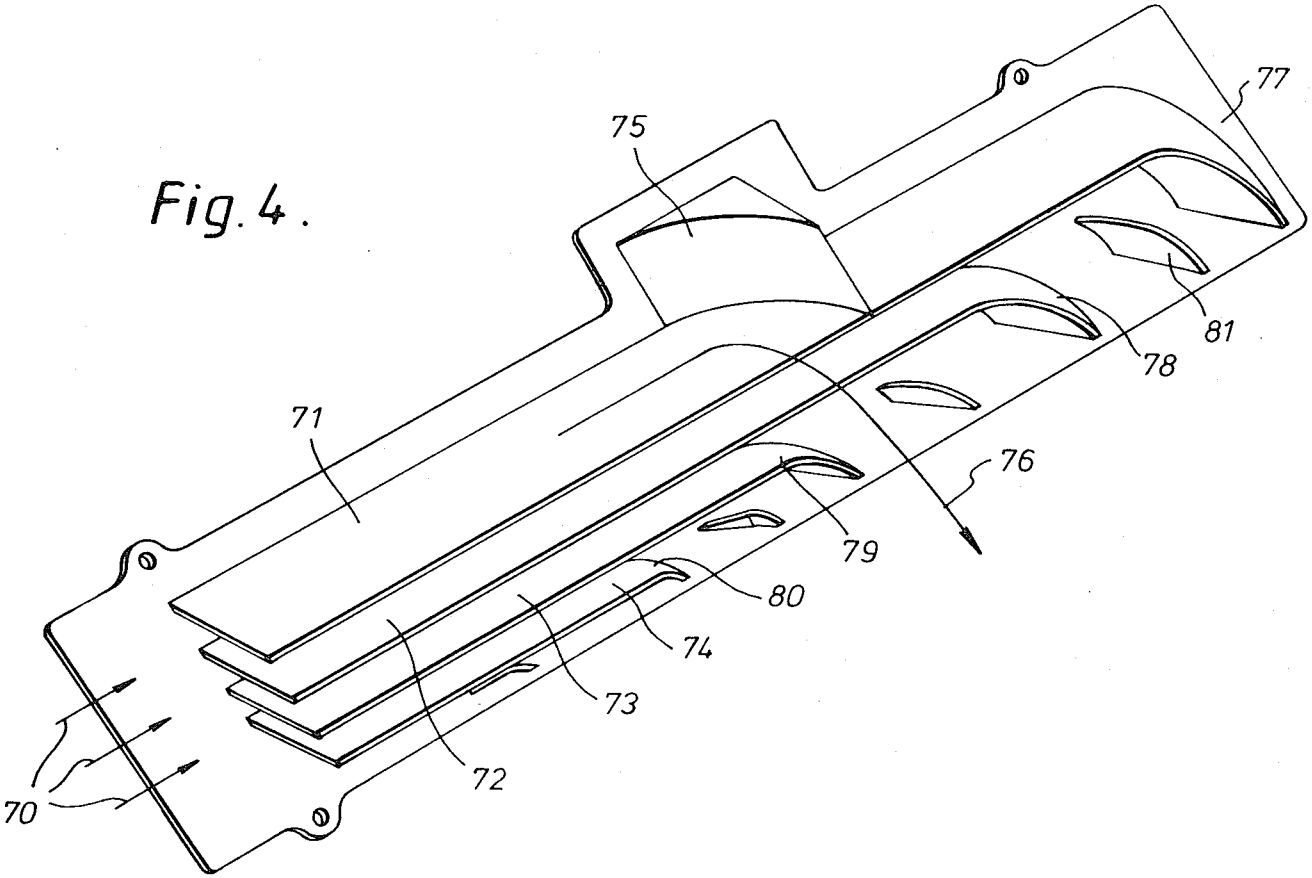
FIG. 4 is a perspective view of part of an air ducting arrangement.

Turning now to FIG. 4, the baffle arrangment 52 is arranged to supply a jet of air to the lamp 14, and a curtain of air over window 54. Air enters the baffle arrangement, which is contained in a duct, at the left-hand end as seen in FIG. 4, and as indicated by arrows 70. The inflowing air is divided by four horizontal divider plates 71, 72, 73, and 74, the uppermost plate 71 directing the air onto a curved diverter 75. This directs a jet of air (arrow 76) towards the lamp 14. The remaining air is divided into four separate flows by the lower three divider plates 72, 73 and 74, the resulting channels having downturned end portions formed by downturned ends 77, 78, 79 and 80 of the divider plates 71, 72, 73 and 74 respectively. The channels are of such dimensions as to produce a uniform downwardly directed curtain of air, and to enhance the uniformity of the curtain, intermediate baffle plates such as plate 81 are provided.

The blowing of air into the optics compartment causes a very slight increase in pressure in the compartment, or at least a net outflow of air from the compartment, which in itself is beneficial in preventing the ingress of toner particles into the optics compartment.

What is claimed is:

1. Xerographic copying apparatus including an optical system for forming an optical image of an object to be copied on an electrically charged photoconductive surface, the optical image forming a corresponding electrostatic latent image on the surface, and means to develop the latent image with a particulate toner material, at least part of the optical system being housed in a substantially closed compartment, with imaging rays being directed out of the compartment in a generally horizontal direction through a substantially vertical transparent window in said compartment, said apparatus further including means to blow a curtain of air generally downwardly over the surface of said window outside the compartment.

2. The apparatus of claim 1 including means to blow air into the optics compartment so as to cause a net outflow of air from the optics compartment.

3. The apparatus of claim 2 wherein an illuminator lamp is contained within the optics compartment, and said means to blow air is arranged to provide cooling of the lamp.

4. An apparatus of claim 2 or claim 3 wherein the means to blow said curtain of air over said window and the means to blow air into said optics compartment comprise a baffle arrangement mounted in an air supply duct.

* * * * *